US005525086A

United States Patent [19]

Gentile et al.

[11] Patent Number: 5,525,086

[45] Date of Patent: Jun. 11, 1996

[54] LAUNCHABLE FIGURINE DEVICE

[76] Inventors: John Gentile, 57 Lloyd Rd., Montclair, N.J. 07042; Anthony Gentile, 134 W. 73rd St., New York, N.Y. 10023; Karyn K. Silfies, 350 Glen Park Way, Brisbane, Calif. 94005

[21] Appl. No.: 403,225

[22] Filed: Mar. 13, 1995

[51] Int. Cl.[6] ..... A63H 27/127; A63H 1/20; A63H 1/90

[52] U.S. Cl. ..... 446/41; 446/37; 446/234; 446/238

[58] Field of Search ..... 446/34, 36, 37, 446/38, 39, 40, 42, 43, 41, 45, 48, 57, 58, 59, 60, 435, 234, 236, 237, 238

[56] References Cited

U.S. PATENT DOCUMENTS

| | | | |
|---|---|---|---|
| 447,284 | 2/1891 | Del Valle . | |
| 481,182 | 8/1892 | Lochmann . | |
| 693,297 | 2/1902 | Melville . | |
| 982,653 | 1/1911 | Wilson | 446/39 |
| 986,578 | 3/1911 | Komar | 446/39 |
| 1,146,333 | 7/1915 | King . | |
| 1,552,093 | 9/1925 | Thompson . | |
| 1,981,050 | 11/1934 | Lee . | |
| 2,242,770 | 5/1941 | Ayers . | |
| 2,410,726 | 11/1946 | Friedman . | |
| 2,561,554 | 7/1951 | Barist . | |
| 2,667,352 | 1/1954 | Sepersky | 446/45 X |
| 2,731,767 | 1/1956 | Holt | 446/38 |
| 2,863,257 | 12/1958 | Gribben . | |
| 2,931,132 | 4/1960 | Griessl . | |
| 3,246,424 | 4/1966 | Gregory . | |
| 3,479,764 | 11/1969 | Meyer et al. | 446/41 |
| 3,555,720 | 1/1971 | Datilo . | |
| 3,605,328 | 9/1971 | Kilroy, Jr. | 446/41 |
| 3,664,670 | 5/1972 | Glass et al. . | |
| 3,722,132 | 3/1973 | Seefluth | 446/36 |
| 3,995,392 | 12/1976 | Goldfarb et al. | 446/58 |
| 4,107,871 | 8/1978 | Hornsby, Jr. . | |
| 4,112,613 | 9/1978 | Toplak . | |
| 4,149,338 | 4/1979 | Wolf | 446/186 |
| 4,180,939 | 1/1980 | Matsushiro | 446/38 |
| 4,202,133 | 5/1980 | Sahar | 446/37 X |
| 4,204,359 | 5/1980 | Plo . | |
| 4,654,018 | 3/1987 | Farrington et al. . | |
| 4,781,642 | 11/1988 | Stanzel | 446/38 |
| 5,334,079 | 8/1994 | Gentile et al. . | |

FOREIGN PATENT DOCUMENTS

| | | | |
|---|---|---|---|
| 2383686 | 11/1978 | France | 446/40 |
| 589172 | 12/1933 | Germany | 446/39 |
| 1478293 | 12/1962 | Germany | 446/38 |
| 1195212 | 6/1965 | Germany | 446/37 |
| 5228265 | 9/1993 | Japan | 446/36 |
| 498642 | 1/1939 | United Kingdom . | |

*Primary Examiner*—Robert A. Hafer
*Assistant Examiner*—D. Neal Muir
*Attorney, Agent, or Firm*—Dergosits & Noah

[57] ABSTRACT

A launchable figurine device includes a figurine having wings capable of providing aerodynamic lift upon rotation of the figurine. A rotation imparting mechanism is releasably mated with the figurine to provide the requisite rotational velocity for launching the figurine into the air.

28 Claims, 13 Drawing Sheets

LAUNCHABLE FIGURINE DEVICE

BACKGROUND OF THE INVENTION

1. Field of the Invention

The present invention relates to toy figurines and, more particularly, toy figurines which can become airborne by design.

2. Description of Related Art

Toy figurines, such as dolls, have long been the object of children's fancy. Likewise, flying toys such as planes and helicopters, which may be driven by propellers and the like, have been immensely popular since the discovery of contemporary aerodynamics. An aerial toy is described in U.S. Pat. No. 1,552,093, wherein the toy has a head of two oppositely extending wings connected to a spindle. A detachable string is wound around the spindle and threaded through a hole on a guide member. The guide, which is capable of supporting the spindle, is held and the string is pulled to impart rotation to the spindle. Rotation of the wings causes the spindle to fly upward until rotation of the spindle and wings slows down and the device begins to drop. U.S. Pat. No. 1,981,050 is another example of a flying propeller blade and shaft wherein the propeller and shaft are caused to fly by pulling a string wound around the shaft.

Another example of a flying toy is found in U.S. Pat. No. 4,112,613, wherein a flying top having an elongated portion for winding a string therearound and an enlarged upper portion which is provided with wings for flying the top upon rapid unwinding of the string.

The search for stimulating variations of flying toys is ongoing. The present invention is a result of that search.

SUMMARY OF THE INVENTION

The present invention provides a launchable figurine device which includes a figurine and a rotation imparting mechanism. The figurine includes at least one wing and a release coupling. The rotation imparting mechanism is mechanically coupled to the figurine release coupling wherein upon actuation of the rotation imparting mechanism, the figurine is caused to rotate and, when sufficient rotational velocity is achieved, the wing creates lift sufficient to launch the figurine into the air.

In another embodiment, the present invention provides a launchable figurine device which includes a figurine and a rotation imparting mechanism including a force imparting member. The figurine includes an upper portion and a lower portion, the upper portion including at least one wing attached thereto, the lower portion having a release coupling mounted thereon. The rotation imparting mechanism includes a release coupling designed and configured to releaseably mate with the release coupling of the figurine to indirectly couple the force imparting member to the figurine. When the figurine release coupling and the rotation imparting mechanism release coupling are releaseably mated and upon actuation of the rotation imparting mechanism through the force imparting member, the figurine is caused to rotate and when sufficient rotational velocity is achieved, the wing creates lift sufficient to launch the figurine into the air.

In another embodiment, the present invention provides a launchable figurine device which includes a figurine and a launch assembly. The figurine includes at least one moveable wing which is pivotally attached to the figurine. The moveable wing has a range of motion in relation to an axis of the figurine whereby upon rotation of the figurine, the unattached end of the moveable wing moves out centrifugally along the range of motion. In one aspect, the wing is capable of moving anteriorly or posteriorly in relation to the figurine. The figurine also includes a release coupling for releasably mating with the launch assembly. The launch assembly includes a housing which, in one aspect, contains a rotary mechanism having a release coupling designed and configured to releasably mate with the release coupling of the figurine. When the figurine and the launch assembly are releasably mated, and upon actuation of the rotary mechanism, the figurine is caused to rotate thus causing the moveable wing to move centrifugally along the range of motion to an outspread position. When a sufficient rotational velocity is achieved, the outspread wing creates lift sufficient to launch the figurine into the air.

In another embodiment, the present invention provides a figurine and a rotation imparting mechanism. The figurine includes at least one wing and a release coupling. The rotation imparting mechanism includes a first gear assembly and a second gear assembly which operate independently of each other to cause rotation of the figurine. The first gear assembly is actuated by a first force imparting member and the second gear assembly is actuated by a second force imparting member.

In another embodiment, the present invention provides a launchable figurine device which includes a figurine and a rotation imparting mechanism. The figurine includes at least one wing and a release coupling. The rotation imparting mechanism includes a release coupling designed and configured to releaseably mate with the release coupling of the figurine. The rotation imparting mechanism also includes and a manually operable force imparting member. When the figurine and rotation imparting mechanism are releaseably mated, the figurine release coupling and the force imparting member are mechanically coupled with a predetermined mechanical advantage.

In another embodiment, the present invention provides a launchable figurine device which includes a figurine and a free-standing launch assembly. The figurine includes at least one wing and a release coupling positioned in a bottom portion of the figurine. The launch assembly includes a free-standing housing containing a rotation imparting mechanism mechanically coupled to the figurine release coupling such that the figurine projects upwardly from the housing with substantially all of the figurine exposed except all of the release coupling of the figurine. When the figurine and launch assembly are mechanically coupled, and upon actuation of the rotation imparting mechanism, the figurine is caused to rotate, and when sufficient rotational velocity is achieved, the wing creates lift sufficient to launch the figurine in the air.

In another embodiment, the present invention provides a launchable figurine device which includes a figurine and a launch assembly. The figurine includes at least one wing, a release coupling and a figurine release coupling housing. The launch assembly includes a release coupling housing and a rotation imparting mechanism mechanically coupled to the figurine release coupling. The launch assembly release coupling housing rotatably and slidably receives the figurine release coupling housing to assist in the automatic alignment of the figurine and launch assembly release couplings.

In another embodiment, the present invention provides a launchable figurine device which includes multiple rotation imparting mechanisms.

In another embodiment, the present invention provides a launchable figurine device which includes a plurality of figurines and a rotation imparting mechanism. The rotation imparting mechanism is mechanically coupled to the plurality of release couplings on the figurines.

DETAILED DESCRIPTION OF THE INVENTION

The present invention provides an aesthetically pleasing toy which includes a figurine that is capable of flying when launched into rotational flight by a rotation imparting mechanism which, in one aspect is defined as a launch assembly. In this manner, at least three highly desirable aspects of toy design are combined. First, figurines and launch assemblies may be designed and configured to assume a variety of shapes and/or characters capable of stimulating the imagination; second, the airborne figurine is a fascinating object of attention; and third, the launch assembly may be manually activated by pulling a pull string or turning a crank which provides physical stimulation to the person launching the figurine.

The present invention will now be described with reference to the preferred embodiment in which the figurine is a humsnoid configuration. However, as stated above and described below, it will be apparent that other figurines may be substituted for the humanoid configuration.

Figure 1:
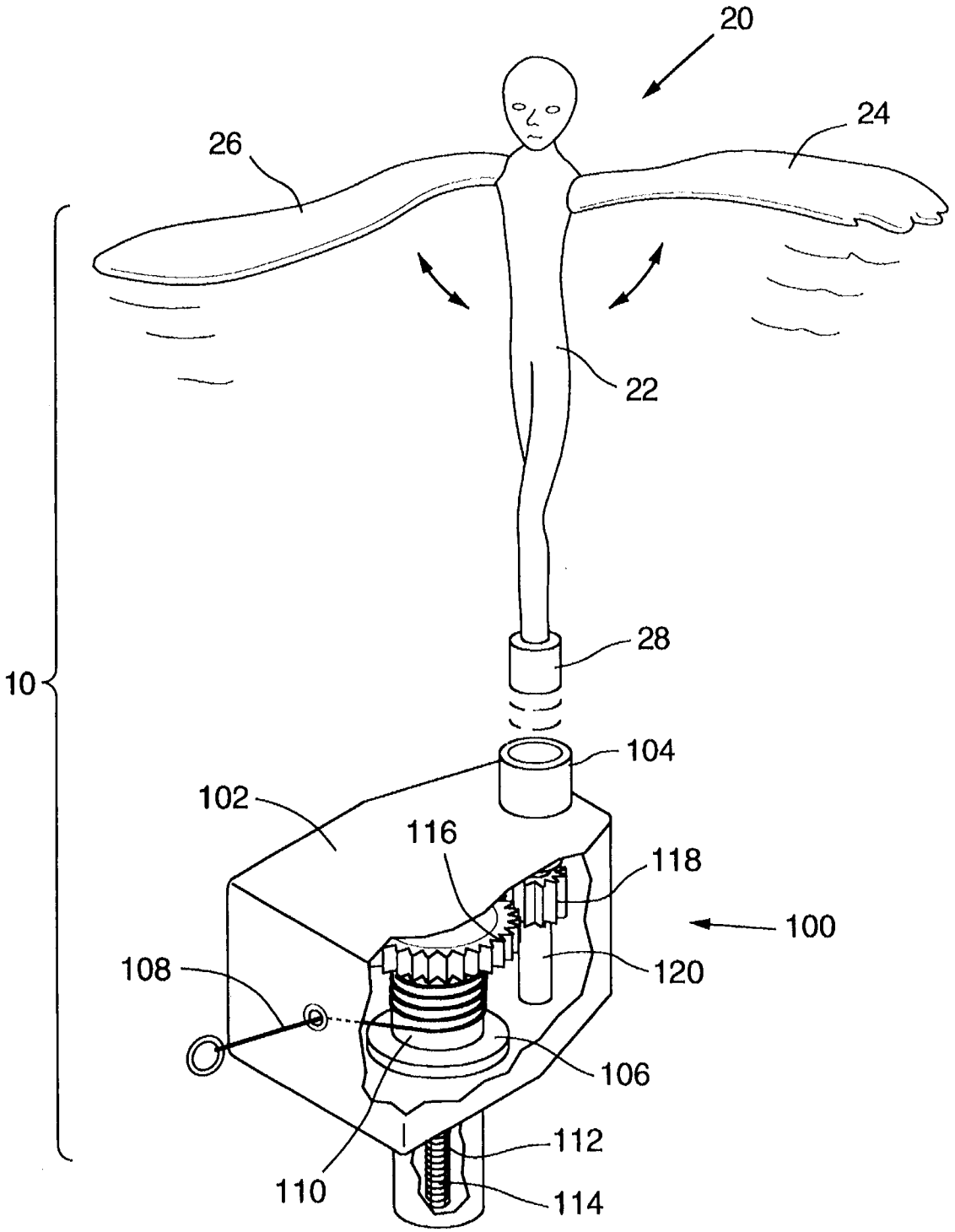
FIG. 1 is a perspective, partial cut-away view of a figurine and a launch assembly according to the present invention.

Referring to the drawings and particularly to FIG. 1, there is shown an example of a launchable figurine device 10 in accordance with the present invention. A figurine 20 includes a body stem 22 which receives at least one wing. A first wing 24 is pivotally situated at a shoulder of the body stem 22. Likewise, a second wing 26 may be incorporated which is pivotally situated at the opposite shoulder. The wings are free to move from being substantially parallel to the body stem 22 to being substantially perpendicular thereto and back again, each wing thus capable of assuming an outspread position. In one embodiment, the first wing 24 is capable of moving posteriorly along an axis of rotation ranging from about 0 degrees to about 100 degrees and, more preferably, from about 5 degrees to about 85 degrees, while the second wing 26 is capable of moving anteriorly along an axis of rotation ranging from about 0 degrees to about 100 degrees and, more preferably, from about 5 degrees to about 85 degrees. In another embodiment, the wings are capable of moving laterally in opposite directions, respectively, from being substantially parallel to the body stem 22 to being outspread and substantially perpendicular thereto and back again. As above, the axis of rotation of each wing may range from about 0 degrees to about 100 degrees and, more preferably, from about 5 degrees to about 85 degrees in relation to the body stem 22.

Figure 2:
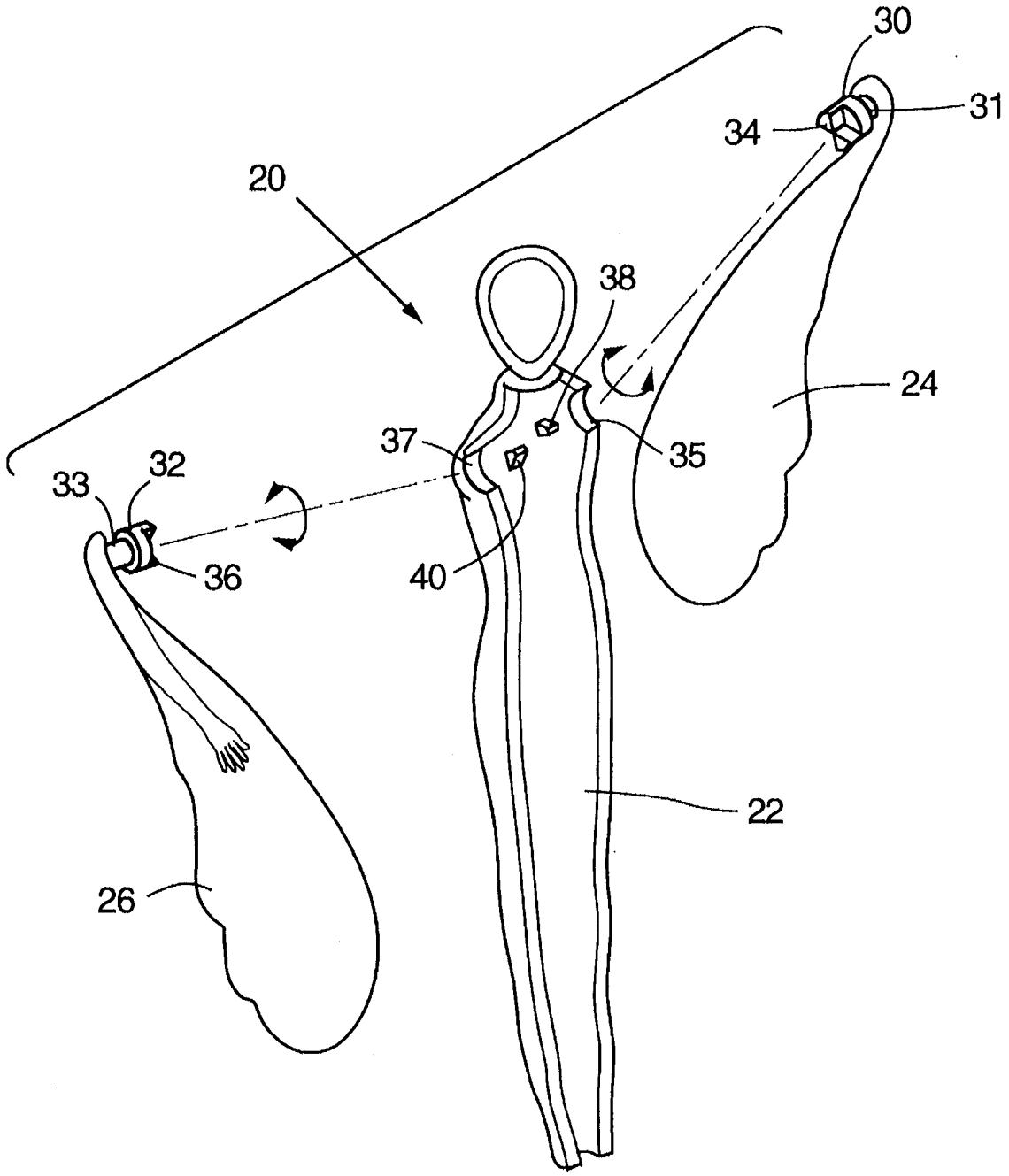
FIG. 2 is an exploded cut-away perspective view of a portion of the figurine shown in FIG. 1.
Figure 3:
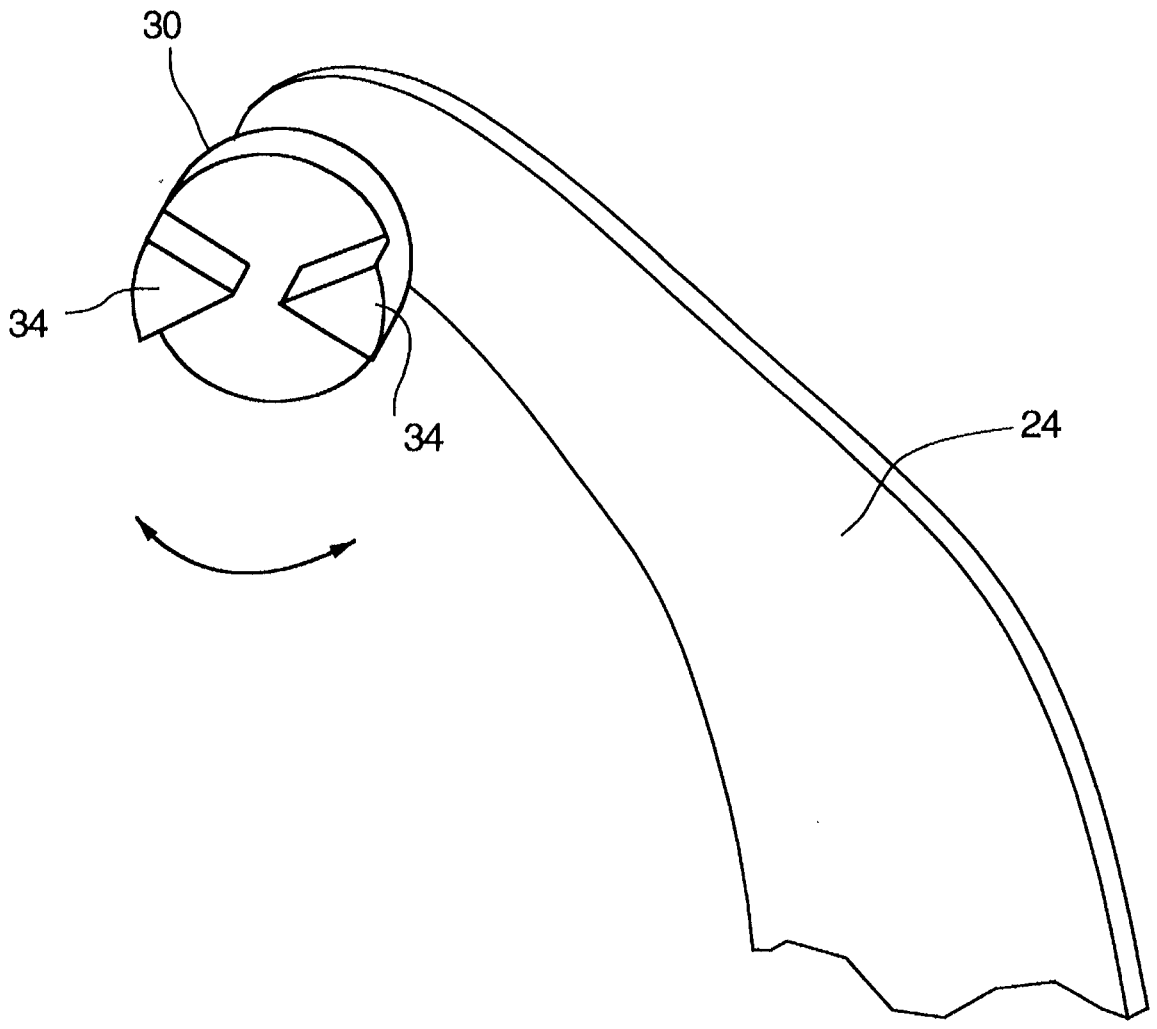
FIG. 3 is a partial perspective view of a wing and rotating portion of a brake assembly according to the present invention.

To provide the wings 24 and 26 with posterior and anterior movement capability, respectively, a pivotal mounting system, such as that illustrated in FIGS. 2 and 3, is utilized. The first wing 24 has a posteriorly pivoting axle 31 mounted perpendicularly at the shoulder-meeting end of the wing 24 which nests in a first axle aperture 35 positioned at the shoulder of the body stem 22. An annular member 30 is coaxially attached to the posteriorly pivoting axle 31, the annular member 30 forming a portion of a brake assembly when the first wing 24 is properly situated at the shoulder. The brake assembly arrests the motion of wings and confines their movement to within the above-described axis of rotation.

The brake assembly includes a rotating portion and a stationary portion. The rotating portion is formed by the annular member 30 and abutment members 34 mounted thereon. The stationary portion has a wedge-shaped braking member 35 rigidly attached to the interior of the body stem 22 and positioned thereon to selectively engage the abutment members 34 when the annular member 30 rotates relative to the breaking member 35. Rotation of the rotating portion is caused by overall movement of the first wing 24 along the posterior axis of rotation. Likewise, the second wing 26 has an anteriorly pivoting axle 33 mounted perpendicularly at the shoulder-meeting end of the wing 26 which nests in a second axle aperture 37 positioned at the other shoulder of the body stem 22. An annular member 32 is coaxially attached to the anteriorly pivoting axle 33, the annular member 32 forming a portion of the brake assembly when the second wing 26 is properly situated at the other shoulder. The brake assembly includes a rotating portion and a stationary portion. The rotating portion is formed by the annular member 32 and abutment members 36 mounted thereon. The stationary portion has a wedge-shaped braking member 40 rigidly attached to the interior of the body stem 22 and positioned thereon to selectively engage the abutment members 36 when the annular member 32 rotates relative to the breaking member 40. Rotation of the rotating portion is caused by overall movement of the second wing 26 along the anterior axis of rotation.

Figure 4:
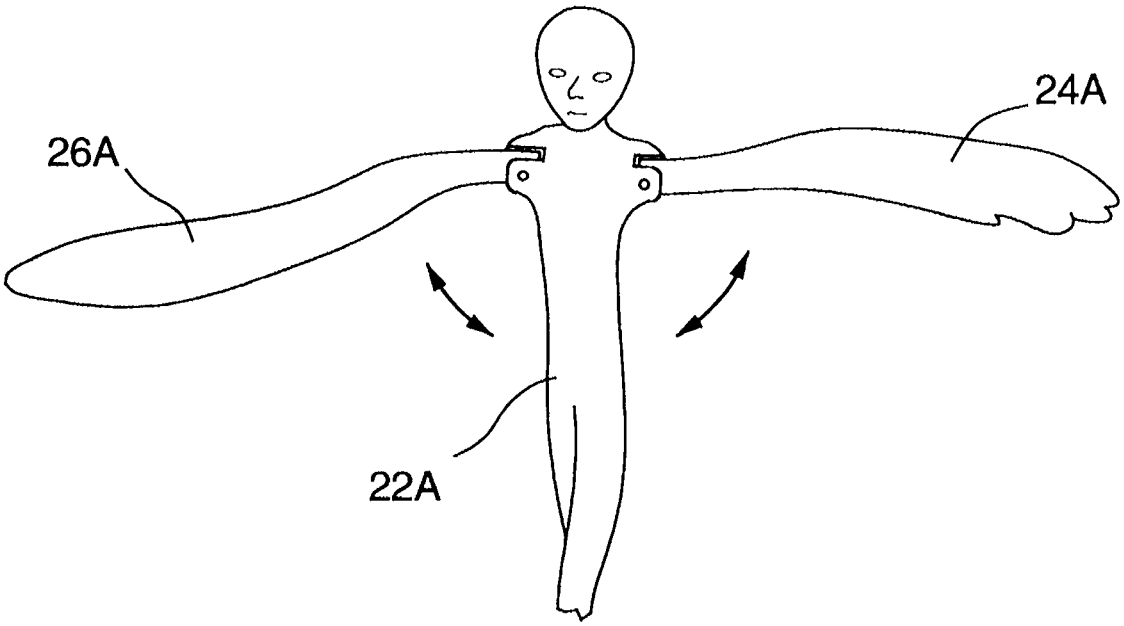
FIG. 4 is a partial perspective view of another embodiment of a figurine according to the present invention.
Figure 5:
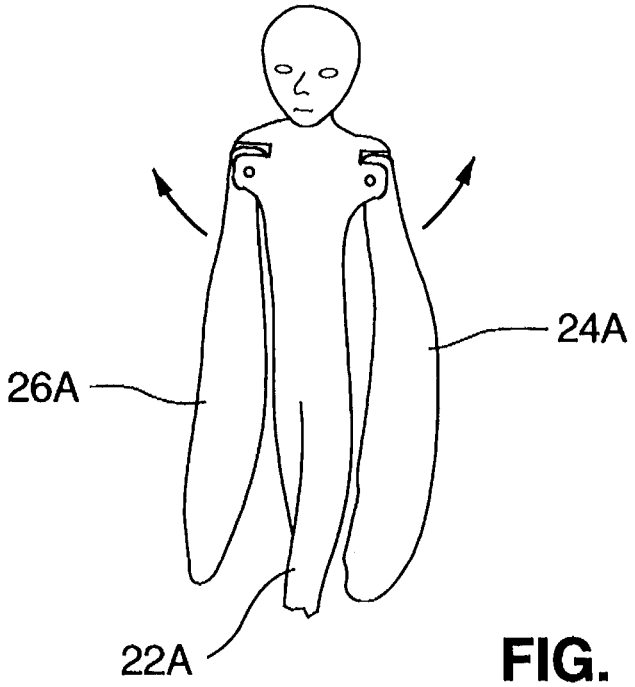
FIG. 5 is another view of the figurine illustrated in FIG. 4.

To provide the wings with a lateral range of motion, as can be seen from FIGS. 4 and 5, the wings 24A and 26A are pivotally mounted at diametrically opposed shoulders and are free to swing laterally away from the body stem 22A along the lateral range of motion. Movement of each wing 24A and 26A is arrested by a suitable stop formed from the combination of the end of the wing and the shoulder, e.g., a square shoulder within the joint, against which the square inner end of the pivoting wing is made to abut. Those with skill in the art are capable of adapting numerous kinds of known stops within the joint formed between the wings and shoulders for arresting movement of the wings at the limits of the range of motion.

In one embodiment of the present invention, the wing(s) are rigidly mounted to the figurine. In this manner, the wing(s) are situated at an aerodynamically acceptable angle in relation to the stem of the figurine. By aerodynamically acceptable, it is meant that the wings extend out from or are situated over or under the stem of the figurine such that when the figurine achieves sufficient rotational velocity, the fixed position of the wing(s) in cooperation with the wing design provides lift sufficient to launch the figurine into the air.

The figurine also includes a figurine release coupling housing 28 which is designed and configured to function either as a releasable coupling itself or to provide a cover to a release coupling for releasably mating with a release coupling contained in a launch assembly 100. In one embodiment, the figurine release coupling housing 28 is designed and configured to assist in the automatic alignment of the figurine and launch assembly release couplings by functioning as a guide. As can be seen in FIG. 1, the release coupling housing 28 corresponds with and is complementary to the launch assembly release coupling housing 104. Thus, the outer diameter of the figurine release coupling housing 28 is somewhat less than the interior diameter of launch assembly release coupling housing 104 and is comfortably received and supported therein. In a preferred embodiment, the release couplings include a separable clutch assembly, such as the examples illustrated in FIGS. 14 and 15, which is utilized to mate the figurine 20 to the launch assembly 100. The release couplings mate so that rotational force which is generated from the launch assembly 100 is imparted to the figurine 20 through the couplings which separate in a substantially frictionless manner as the figurine is launched into rotational flight.

Figure 14:
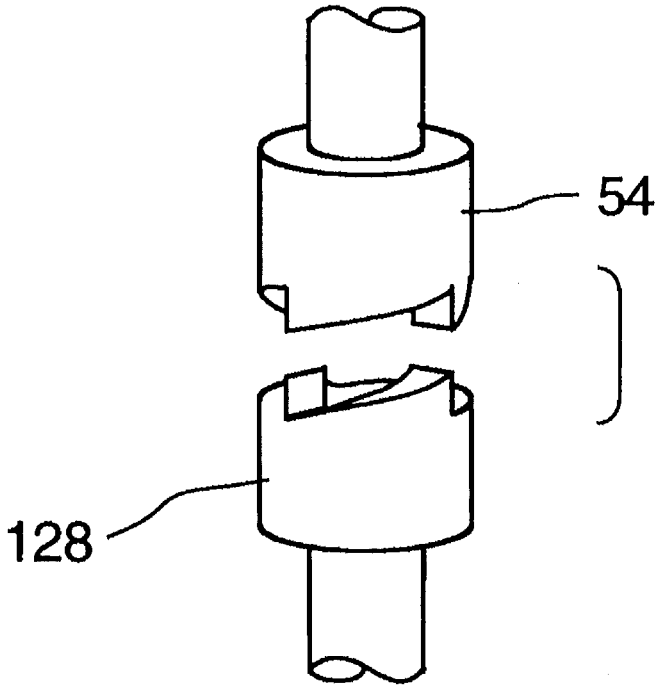
FIG. 14 is a perspective view of a spiral jaw clutch.
Figure 15:
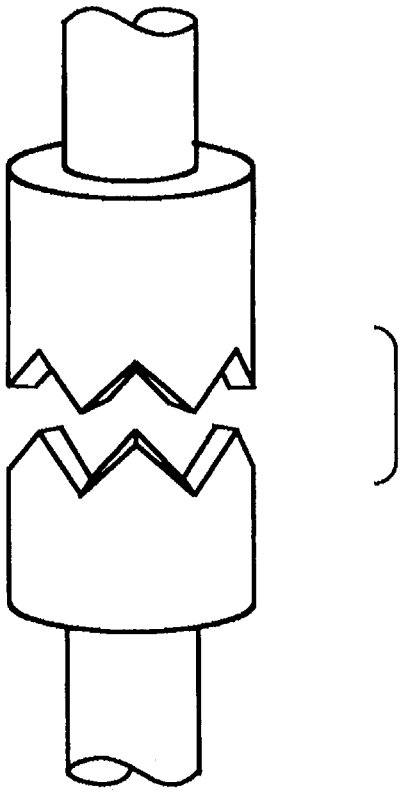
FIG. 15 is a perspective view of a saw-tooth clutch.

A spiral jaw clutch, illustrated in FIG. 14, may be used in accordance with the present invention for positive, unidirectional drive, i.e., rotation is imparted in one direction while slippage occurs in the other direction when sufficient force causes the camming surfaces to ride over each other. Alternatively, a saw-tooth clutch, such as that illustrated in FIG. 15, may be used in accordance with the present invention, to transmit torque in either direction. These release couplings are especially preferred because they automatically align when pressed together. It is contemplated that those with skill in the art can utilize other known separable or releasable couplings such as a square jaw clutch in accordance with the present invention to releasably couple the figurine 20 to the launch assembly 100.

Figure 6:
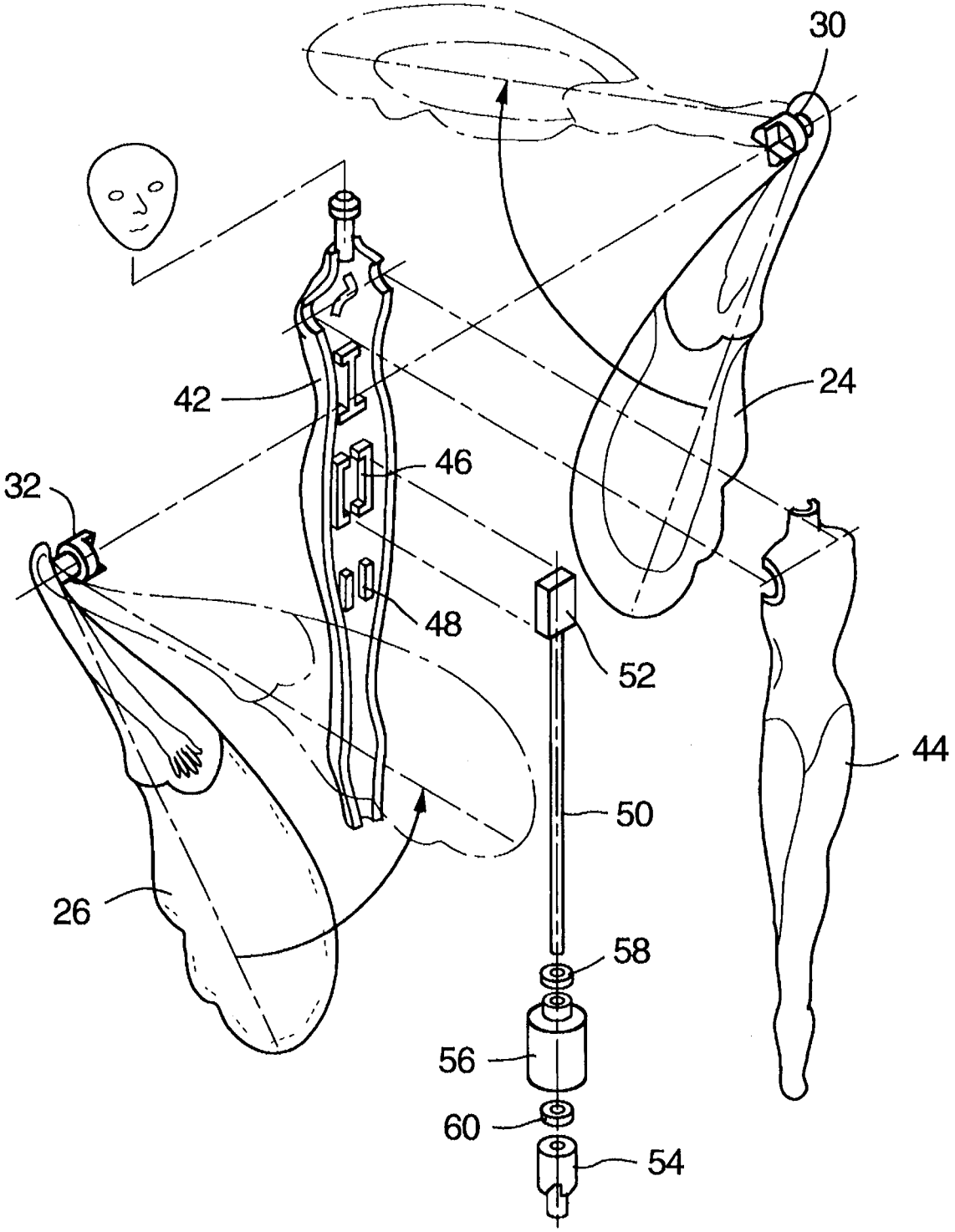
FIG. 6 is an exploded perspective view of another embodiment of a figurine according to the present invention.

In one embodiment, the figurine mounted release coupling is attached directly to the body stem. In another embodiment, the figurine mounted release coupling, for example in the form of a spiral jaw clutch 54, is attached to a shaft 50 as illustrated in FIG. 6. A cut-away back half of the body stem 42 receives the wings 24 and 26 including the brake assembly as described above. The shaft is positioned coaxially within the body stem 42. A first shaft support 46 receives and stabilizes a shaft support engagement member 52 which is rigidly attached to one end of the shaft 50. When properly positioned, the shaft 50 nests in a second shaft support 48 which keeps the shaft 50 in substantially coaxial alignment with the body stem 42. The other end of the shaft 50 has a figurine release coupling 54 rigidly attached thereto. More specifically, the figurine half of the spiral jaw clutch 54 is rigidly attached coaxially to the end of the shaft 50. A shaft mounted release coupling housing 56 is slidably mounted on the shaft 50 and is free to rotate coaxially around the shaft 50 with the assistance of washers 58 and 60. The front half of the body stem 44 may optionally include corresponding first and second shaft supports that align with the shaft supports on the back half of the body stem 42 to further support the shaft 50 when the back and front halves 42 and 44 are put together. The shaft mounted release coupling housing 56 and the figurine half of the spiral jaw clutch 54 extend outside the bottom of the entire body stem 22. In an alternative embodiment, the shaft is adapted to couple directly to the wing(s) and provide the posterior/anterior or lateral range of rotation described.

Figure 7:
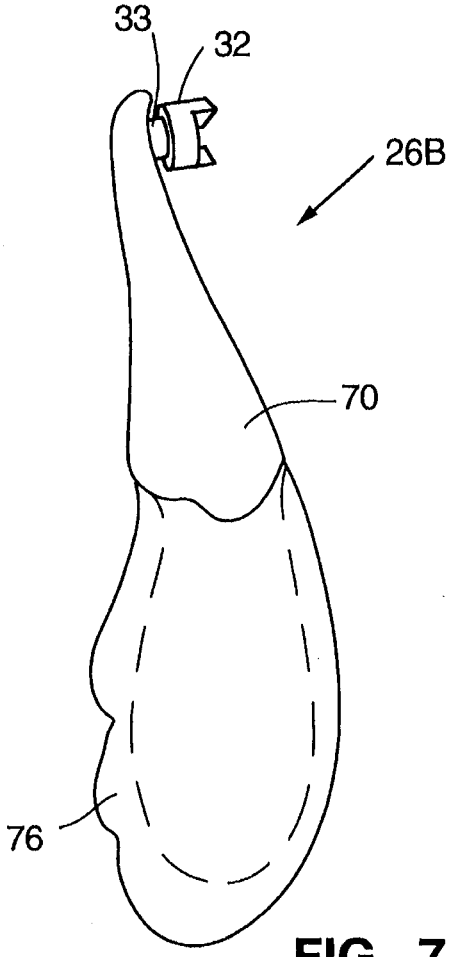
FIG. 7 is a perspective view of a wing assembly according to the present invention.
Figure 8:
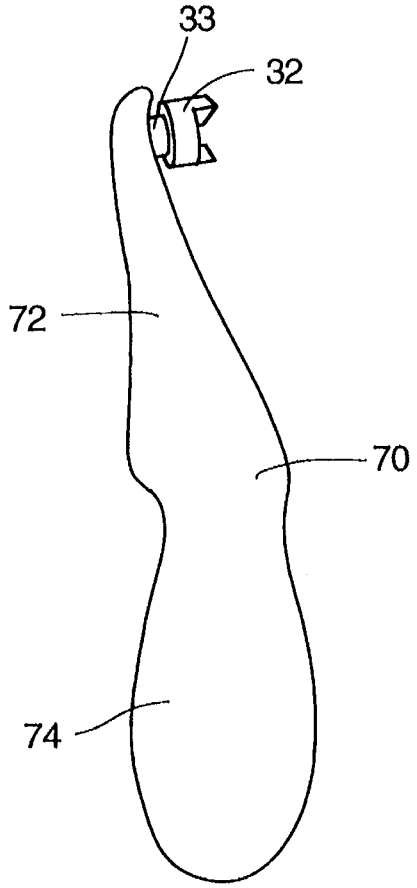
FIG. 8 is a perspective view of a portion of the wing assembly shown in FIG. 7.
Figure 9:
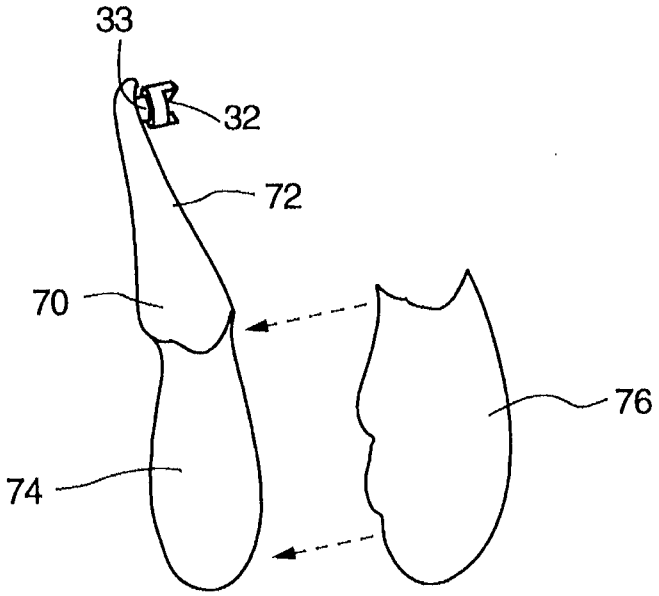
FIG. 9 is an exploded perspective view of the wing assembly shown in FIG. 7.

The wings used in accordance with the present invention are light weight and are designed and configured to provide airfoil lift to the figurine when sufficient rotational velocity is achieved. The aerodynamics of airfoil propellers and wings are well known and it is contemplated that various known wing and/or propeller shapes are adaptable for use herein. The figurine 20 is appropriately balanced and cooperates with the airfoil to provide an aerodynamically suitable design. In one embodiment illustrated, for example, in FIGS. 7 through 9, the wings are jacketed with a soft, resilient foam to provide cushioning and protection for the wings. A second wing 26B is seen to include a foundation 70 having an upper portion 72 and a lower portion 74. The upper portion 72 has the rotating portion of the brake assembly mounted thereon (see, e.g., annular member 32 and pivoting axle 33). The lower portion 74 receives a jacket 76 which mounts over and adheres to the lower portion 74. The foundation 70 and jacket 76 combine to form an airfoil structure capable of providing sufficient lift to propel the spinning figurine into the air. The jacket 76 provides a lightweight appendage to the foundation 70 which can be made of a sturdy and/or rigid supporting material that provides the wings with sufficient strength to withstand the stress associated with flying.

Well known light-weight metals or polymeric materials are suitable for use in fashioning the foundation 70. The jacket 76 is not necessarily as rigid as the foundation 70 and, in a preferred embodiment, is fabricated from light weight resilient polymer such as urethane or other foaming polymers known in the art. Other examples of suitable polymers are provided below. The jacket 76 functions as a shock absorbing safety device which helps protect the rapidly spinning wings from damage and also protects the user and any bystanders in the event of a collision. As such, the impact of the rapidly spinning wings is attenuated by the jacket 76. Although the jacket 76 is shown as mounting over the lower portion 74 of the foundation 70, it is contemplated that various configurations may be incorporated, e.g., the jacket may cover the entire foundation 70 or, as an alternative, the wing 26B may be fabricated partially or entirely from a soft resilient polymer of sufficient strength to withstand the force of flying and still maintain its function as an airfoil. In accordance with the present invention, the wings may be molded into a variety of aesthetically pleasing shapes such as arms with hands or butterfly-like fairy wings and the like as long as the overall configuration provides an airfoil.

As was noted above, rotational force is imparted to the figurine 20 from the rotation imparting mechanism contained in the launch assembly 100. Rotation imparting mechanism is meant to encompass any device which may be used by those with skill in the art to provide torque and resulting rotation to an object. Such mechanisms include, for example, pulleys, levers, and gears, etc. which operate to impart a predetermined mechanical advantage to the user when launching the figurine. Thus, in one aspect, a rotation imparting mechanism according to the present invention allows indirect coupling of a force imparting member which is directly contacted by the user to the figurine through a mechanical coupling.

Figure 10:
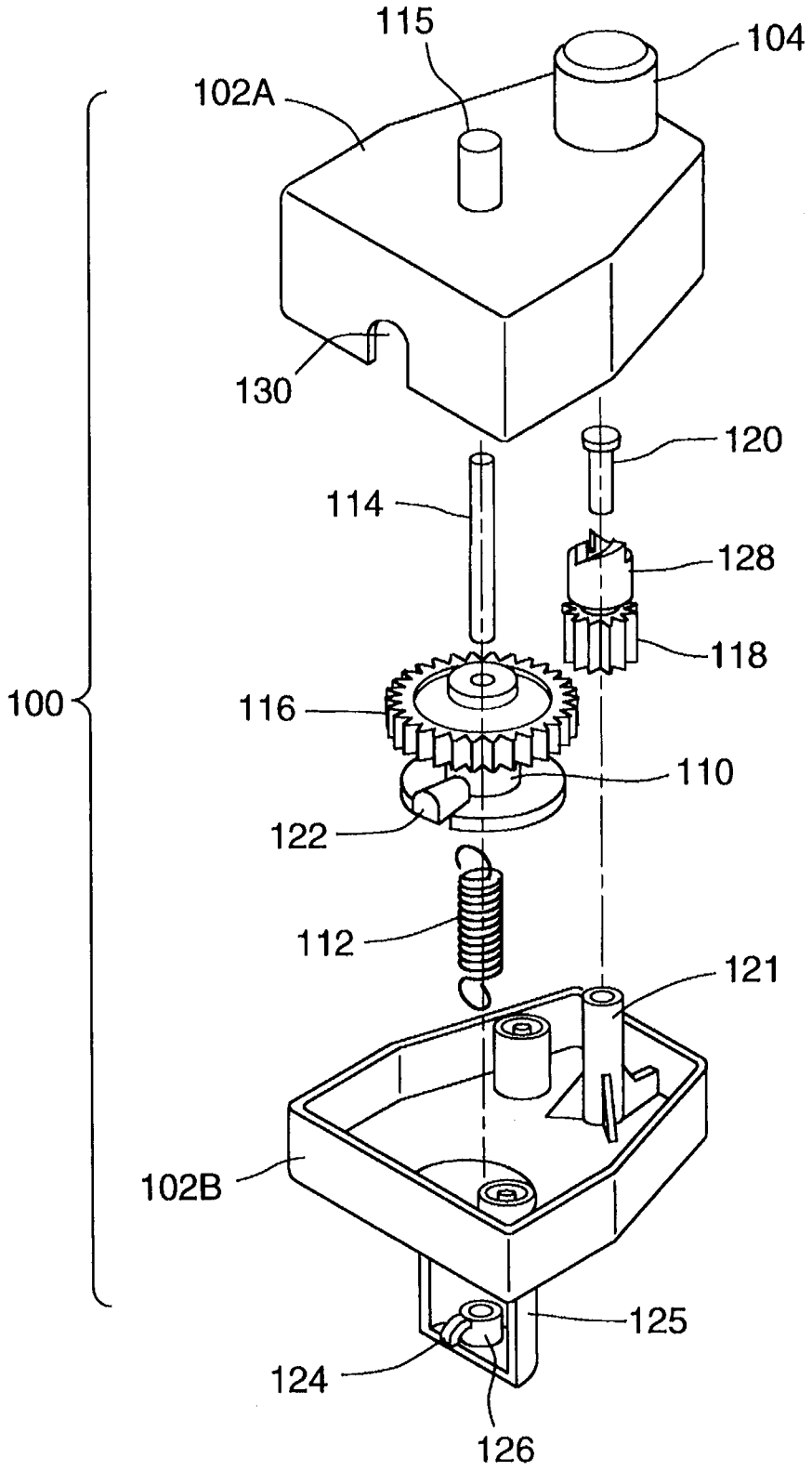
FIG. 10 is an exploded perspective view of the launch assembly shown in FIG. 1.
Figure 11:
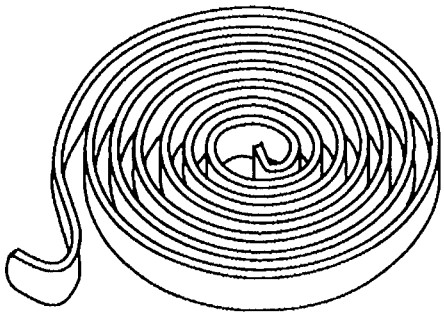
FIG. 11 is a perspective view a flat spiral spring.
Figure 12:
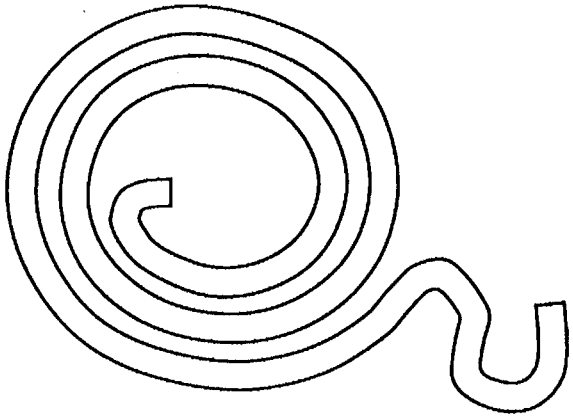
FIG. 12 is a top view of a circular torsion spring.
Figure 13:
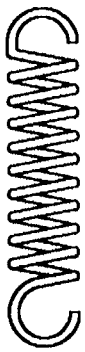
FIG. 13 is a side view of a helical torsion spring.

The launch assembly 100 illustrated in FIGS. 1 and 10 includes a housing 102 consisting of an upper housing portion 102A and a lower housing portion 102B. Contained within the housing 102 is a rotation imparting rotary mechanism 106 including a reel 110 for receiving a pull string 108 which is wound thereabout for drawing against the force of a helical torsion spring 112. A first spur gear 116 is coaxially mounted to the reel 110 such that the first spur gear 116 turns along with the reel 110. The first spur gear 116, the reel 110 and the helical torsion spring 112 are coaxially slidably mounted over a rotary mechanism shaft 114 such that the shaft 114 is threaded through the first spur gear 116, the reel 110, and the helical torsion spring 112. The rotary mechanism shaft 114 is stabilized and mounted to the upper housing portion 102A by means of an upper rotary mechanism shaft anchor 115 and is stabilized and mounted to the lower housing portion 102B by means of a lower rotary mechanism shaft anchor 126. Tension is maintained on the helical torsion spring 112 by an upper torsion lock 122 which is secured to the reel 110, and which receives and holds one or more loops of wire from the uppermost portion of the helical torsion spring 112, and a lower torsion lock 124 which is secured to a helical spring housing portion 125 of the lower housing portion 102B and which receives and holds one or more loops of wire from the lowermost portion of the helical torsion spring 112. Thus, one end of the pull string 108 is secured to the reel 110 and is windable thereabout, the helical torsion spring 112 being secured to the reel 110 for biasing the reel 110 against the force of pulling the pull string 108 and toward keeping the pull string 108 retracted and wound around the reel 110. It should be understood that springs other than helical torsion springs may be used in accordance with the present invention. A helical torsion spring having full round hooks is shown in FIG. 13. Examples of other springs which may be used include a flat spiral spring as shown in FIG. 11 or a circular torsion spring as shown in FIG. 12.

The first spur gear 116 of the rotary mechanism is oriented to be in external meshed contact with a parallel second spur gear 118 such that rotation of the first spur gear 116 imparts rotation to the second spur gear 118. A release coupling 128 is coaxially mounted over the second spur gear 118 such that rotation of the second spur gear 118 imparts rotation to the release coupling 128. The second spur gear 118 and release coupling 128 are stabilized and mounted to the lower housing portion 102B by means of a launching shaft 120 which is received and secured in a launching shaft anchor 121. The launch assembly release coupling 128 is positioned such that at least a portion of it extends into a launch assembly release coupling housing 104.

In another embodiment, a rotation imparting mechanism such as the rotary mechanism is actuated by means of various force imparting members such as a crank or rack and pinion assembly. A hand crank may, for example, be mounted outside of the launch assembly for easy grasping by coaxially mounting it to a crankshaft extending into the launch assembly housing. The crankshaft gear is positioned such that it is in substantially a perpendicular and externally meshed relation to a first spur gear. The first spur gear may directly couple to the release coupling or may indirectly couple to the release coupling through additional gears and/or shafts. Accordingly, rotation of the hand crank ultimately imparts rotation to the release coupling.

A rack and pinion assembly may also be used as a force imparting member in place of the pull string and reel described above. Accordingly, a slot for receiving the rack is positioned in the launch assembly which, either by itself or in cooperation with a rack guide in the rotation imparting mechanism, orients the rack such that upon insertion of the rack in the slot, the teeth on the rack will externally mesh with the teeth on the first spur gear. When the rack is pulled along the slot, the first spur gear rotates, thus causing either direct or indirect rotation of the release coupling. The rack can be in the form of a strap with teeth mounted thereon. In this manner, the action of a "rip cord" is simulated when the strap is engaged in the slot and then pulled out.

The launch assembly release coupling housing 104 is designed and configured to rotatably receive the figurine mounted release coupling housing 28 as shown in FIG. 1, or the shaft mounted release coupling housing as shown in FIG. 6. Thus, the launch assembly release coupling housing and the figurine mounted release coupling housing alone, or in cooperation with the release coupling assembly, permit the figurine 20 to be supported in an upright position on the launch assembly 100. This also assists in the automatic alignment of the figurine and launch assembly release couplings as discussed above. Although cylindrical shaped coupling housings have been illustrated, it is contemplated that any of a variety of geometric shapes are suitable for use in accordance with the present invention, e.g., polygonal, ellipsoid, rectangular, etc.

In accordance with the present invention, a rotation imparting mechanism such as the rotary mechanism provides a gear driven rotational aspect to the release coupling which is utilized to provide a mechanical advantage. In this manner, relatively little effort is needed to impart high torque to the release coupling. The gear ratios may be varied to suit different applications, e.g., a large first spur gear in relation to a small second spur gear allows a faster rotational velocity to be achieved than gears of equal size or a relatively small first spur gear. The versatility of such a rotary mechanism allows use of relatively small-scale force imparting members such as a relatively short pull string to achieve sufficient torque related rotational velocity when launching the figurine. As a result, a user of the launch assembly who has limited strength or a narrow range of motion can easily launch the figurine. Furthermore, a short pull string is easier to retract and less likely to become tangled.

It is contemplated that the figurine 20 and the rotation imparting mechanism such as the above described launch assembly may be constructed from light weight high strength materials, e.g., metals such as aluminum or magnesium, polymeric materials such as ABS plastic, polyvinyl chlorides, terephthalates, nylon, carbonates, olefins, polyesters and the like. Specific examples include polyethylene crosslinked with ethylene vinyl acetate, silicon, polypropylene, polyurethane, ethylene vinyl acetate, expandable polystyrene, polybutylene, KRYTON, LEXAN, DELRIN, and CELCON. Foaming agents which may be used include CELOGEN, KEMPORE, EXPANDEX and the like. Such materials may be molded into a variety of shapes as desired.

In various embodiments, the figurine may incorporate realistic accessories such as hair and clothing. Such accessories should not interfere with the aerodynamic properties of the figurine 20. For example, rooted hair or fur, usually polymeric filaments of, e.g., polyethylene, polypropylene, nylon, etc. is affixed to the figurine by methods known to those with skill in the art. As an example, the hair or fur is affixed by stitching onto the figurine with a commercially available rooting machine. The hair or fur can also be trapped or bonded to a separate plug piece which is then affixed to the figurine. The hair can be gathered into a knot at one end, loose ends are then pulled through any holes or slots in the figurine, leaving knotted/glued ends trapped inside the figurine. Any clothing attached to the figurine should be light weight and is preferably sheer. The rotation imparting mechanism such as the above-described launch assembly may incorporate aesthetically pleasing coverings which are incorporated into or cover the housing. Such coverings may include handpieces for facilitating grasping of the launch assembly and/or base portions for maintaining the launch assembly in a self-standing upright position. In a preferred embodiment, the figurine and rotation imparting mechanism are ornamentally shaped, configured, coordinated and matched to provide a common playset theme. For example, a ballerina figurine may stand atop a flowerbed launch assembly. The releasable nature of the figurine and launch assembly allow for a set of interchangeable figurines to be used with a launch assembly or, conversely, an interchangeable set of launch assemblies to be used with a single figurine or set of interchangeable figurines.

In another embodiment of the present invention, at least one illumination device is incorporated into either or both the figurine and launch assembly. For example, a figurine illumination device is switched on when the wing(s) elevate during rotation, i.e., by the action of the brake assembly. The action of the brake assembly causes a circuit from a battery mounted in the interior of the figurine to be completed when a first electricity conducting contact situated on the rotating portion of the brake assembly on the wing(s) selectively contacts a second electricity conducting brake assembly contact mounted within the body stem, or a circuit is completed when a conducting contact on the brake assembly on the laterally moving wing selectively contacts a conducting contact mounted at the above-described stop within the body stem. Alternatively, a circuit between the battery and light bulb may be completed by circuit bridging contact of a first conducting member which is brought into circuit completing contact with a second conducting member by centrifugal force created by rotation of the figurine. Those with skill in the art may incorporate any known alternative bridging switches into the figurine to cause illumination according to the present invention. The light source may be a bulb or light emitting diode which may be positioned at one or more aesthetically pleasing locations on the figurine. Various illumination devices may be incorporated into any of the launch assemblies described herein. One or more locations on the launch assembly can be made to light up by proper placement of a bulb(s) and/or light emitting diode(s) which is activated along with the rotation imparting mechanism. For example, when the pull string is pulled, a circuit completing switch is activated thus instituting a lighting sequence in the launch assembly.

In operation, the figurine 20 is mounted on the launch assembly 100 by mating any figurine release coupling described above with any corresponding launch assembly release coupling. The pull string 108 is pulled, thereby imparting rotation to the launch assembly release coupling which in turn cooperates with the release coupling of the figurine 20 to cause rotation of the figurine 20. Rotation of the figurine 20 causes the free ends of the wings 24 and 26 to move centrifugally outward along the axis of rotation and assume an outspread orientation. Outward movement of the wings is arrested when the brake assembly prevents further movement of the wings. When a sufficient rotational velocity is achieved, the wings 24 and 26 act as airfoils which lift the figurine 20 into the air.

In another embodiment of the present invention, a rolling launch assembly is provided which is actuated by a force imparting member that rolls along a surface. The rolling energy is transmitted through a rotation imparting mechanism to the figurine which, as above, is capable of flying once sufficient rotational velocity is achieved. The wheel transmits rotational energy to a release coupling similar to the release coupling described above through a linkage of gears, pulleys or the like. In one aspect, a rolling launch assembly housing includes a base having at least one wheel which contacts a surface on which the wheel rolls. The wheel may directly mesh with or frictionally engage a perpendicularly oriented annular member such as a disc or spur gear which is either directly or indirectly connected to the release coupling. The rotating wheel drives the spur gear to rotate the release coupling of the rolling launch assembly which is transmitted to the figurine when it is releasably mated with the rotation imparting mechanism. In this manner, by slowly rolling the rolling launch assembly, the wings of the rotating figurine can be made to spin and/or rise and present an aesthetically pleasing spinning figurine. Alternatively, a gear ratio may be incorporated which steps down rotational velocity, thus allowing the rolling launch assembly to be rolled at relatively high speed without causing the figurine to rotate at a speed sufficient to actually launch the figurine into the air. If desired, the wheel may be linked to the release coupling of the rolling launch assembly in such ratio that when the rolling launch assembly is rolled fast enough, the rotational velocity imparted to the figurine is high enough to easily launch the figurine into the air.

In another embodiment of the present invention illustrated in FIGS. 16 through 19, a rolling launch assembly with flying override 200 incorporates two separately actuated gear assemblies which can operate independently of each other to cause rotation of the figurine. In this manner, a first force imparting member such as the wheel described above in the rolling launch assembly, a crank or electric motor may be used to impart rotation to the figurine through a first gear assembly while a second gear assembly may be actuated by a second force imparting member such as a pull string, a crank or electric motor to impart rotation to the figurine. Electric motors used in accordance with the present invention may be battery powered or run by any other electrical means.

Figure 16:
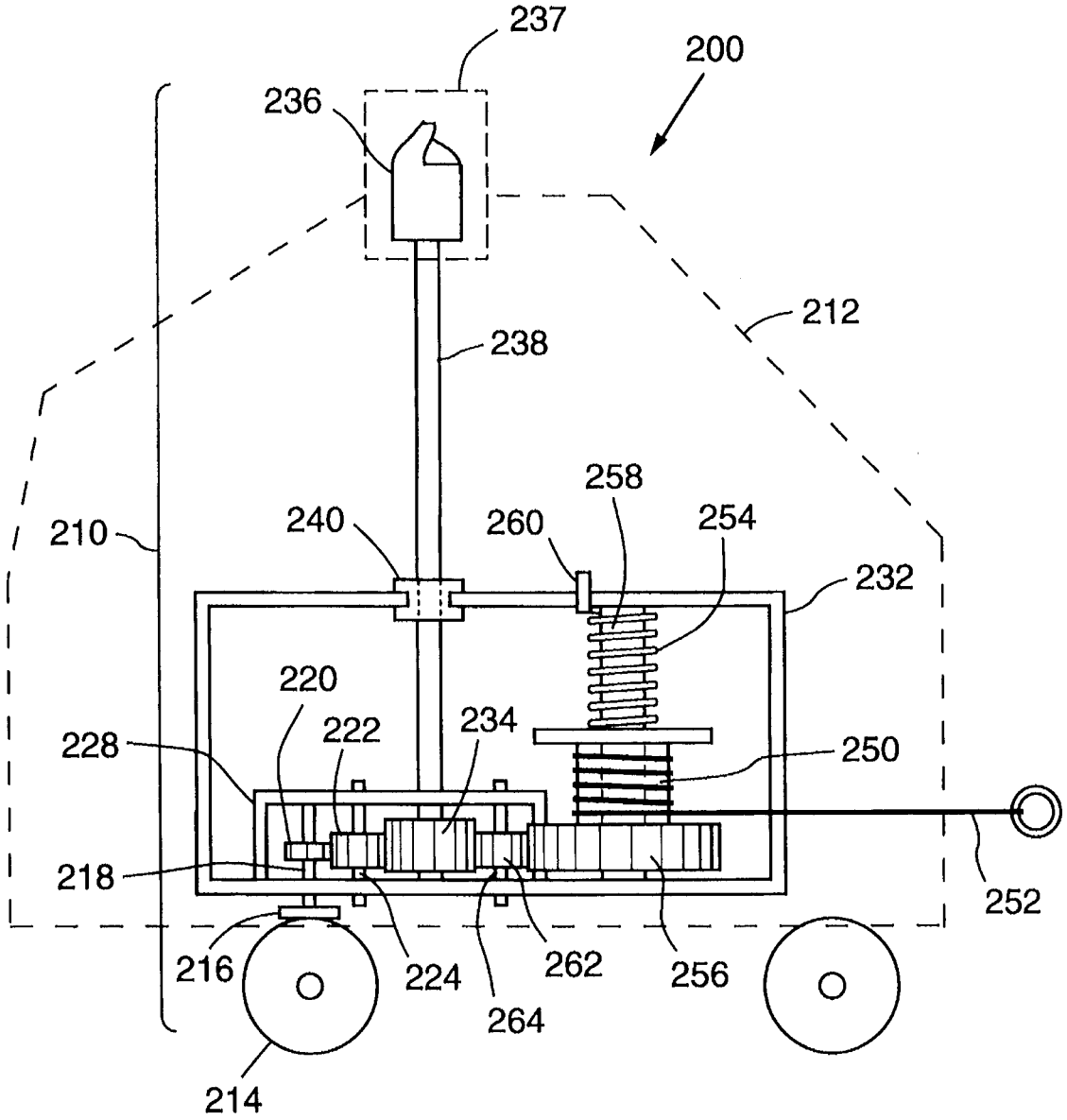
FIG. 16 is a side view of one embodiment of a figurine rotation imparting mechanism in accordance with the present invention.
Figure 17:
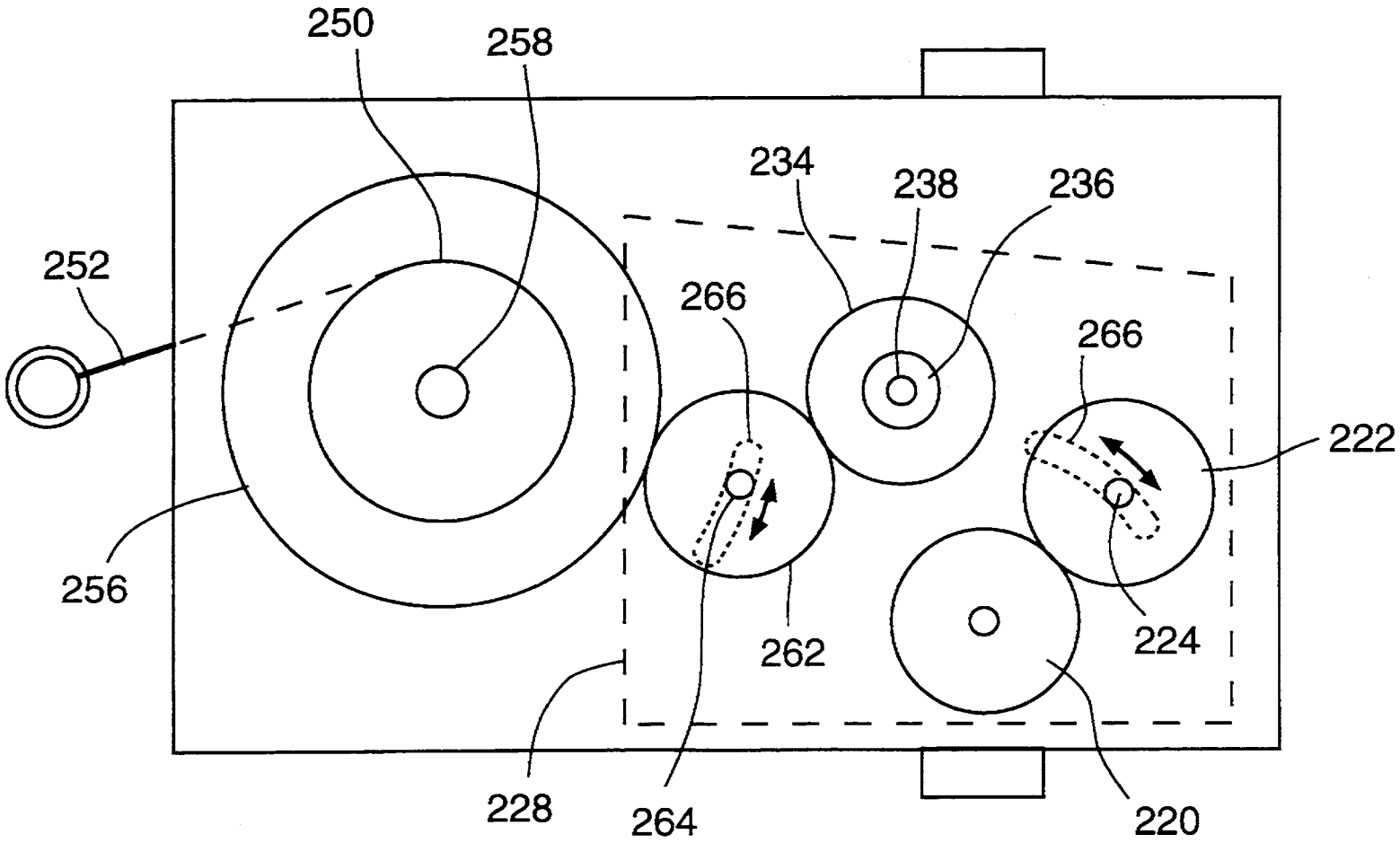
FIG. 17 is a top view of the figurine rotation imparting mechanism illustrated in FIG. 16.
Figure 18:
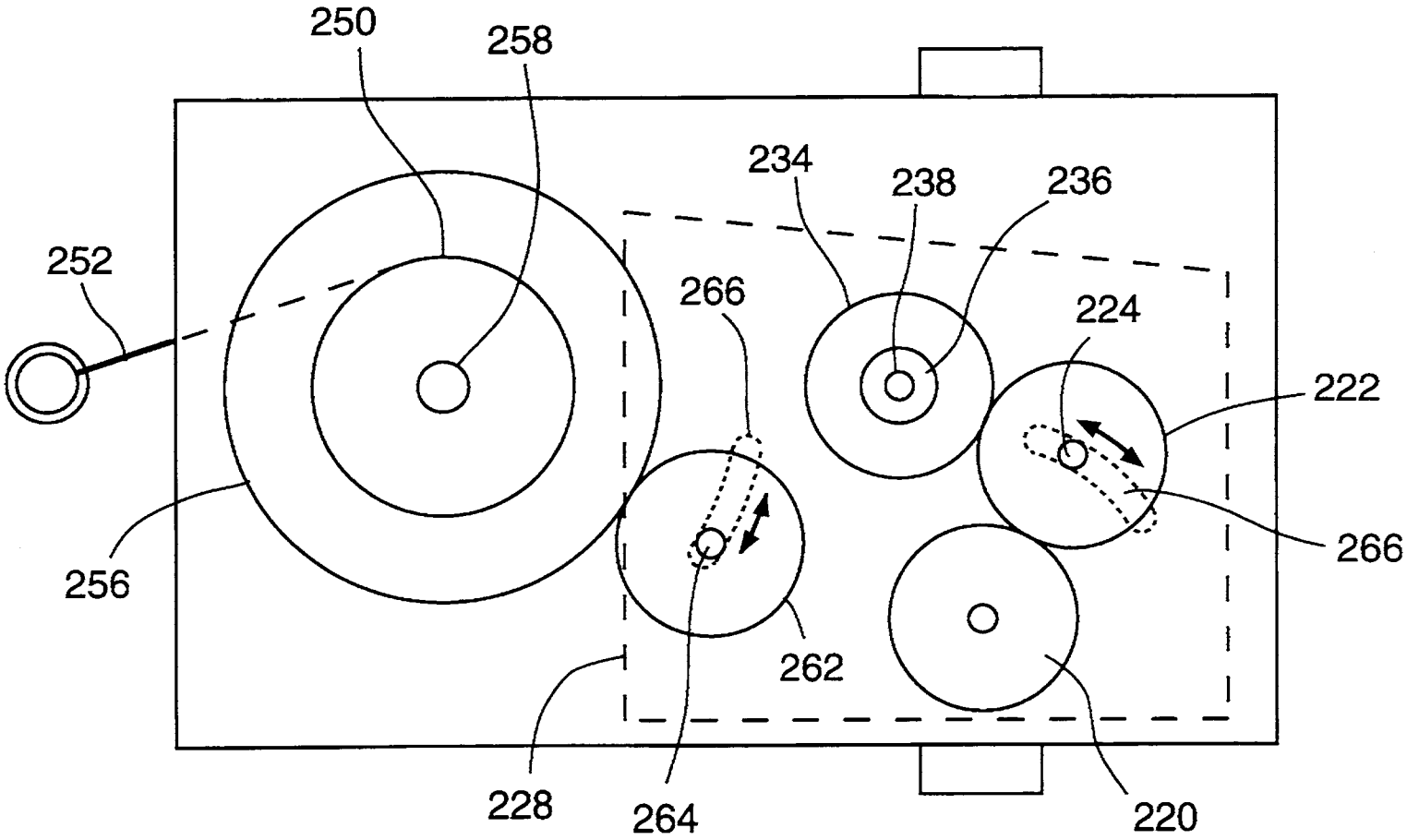
FIG. 18 is another top view of the figurine rotation imparting mechanism illustrated in FIG. 16.
Figure 19:
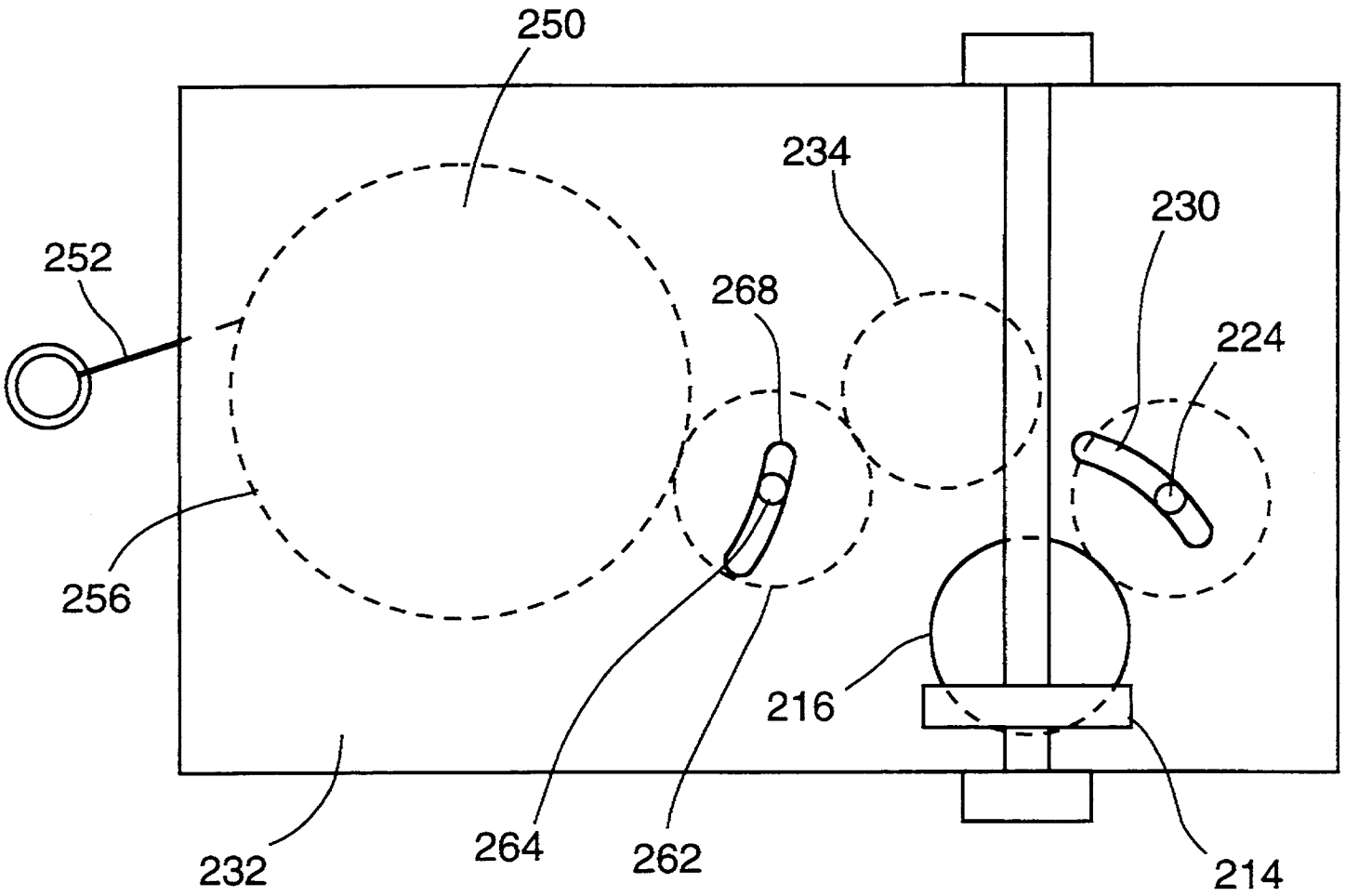
FIG. 19 is a bottom view of the figurine rotation imparting mechanism illustrated in FIG. 16.

Accordingly, the rolling launch assembly with flying override 200 shown in FIGS. 16 through 19 includes a rotation imparting mechanism 210 contained and stabilized in a launch assembly housing 212 (shown in dotted lines in FIG. 16). The first force imparting member is shown to be a wheel 214 which is rotationally mounted to the rolling launch assembly with flying override 200 and is perpendicular to and frictionally engaged to a disc 216 which is coaxially connected by a drive shaft 218 to a first spur gear 220 of the first gear assembly. A second spur gear 222 of the first gear assembly is oriented to be maintained in external meshed contact with the first spur gear 220. The second spur gear 222 is mounted on a second spur gear shaft 224. One end of the second spur gear shaft 224 is slidably retained in an arcuate first slot 226 of a spur gear support housing 228 (shown in dotted lines in FIGS. 17 and 18) and the other end of the second spur gear shaft 224 is slidably retained in an arcuate second slot 230 of a first and second gear assembly housing 232. As the first spur gear 220 rotates, it frictionally advances the slidably mounted second spur gear 222 along the slots 226 and 230 in the direction of rotation. Thus, counterclockwise rotation of the first spur gear 220 (when viewed from the top) advances the second spur gear 222 into external meshed engagement with a release coupling spur gear 234. A release coupling 236 is coaxially mounted to a release coupling shaft 238 to which the release coupling spur gear 234 is also coaxially mounted. One end of the release coupling shaft 238 is fixed, but rotationally mounted to the bottom of the first and second gear assembly housing 232 and is rotationally supported by a release coupling shaft support 240. The release coupling 236 may be contained in launch assembly release coupling housing 237 which is designed and configured to assist in the automatic alignment of the figurine and launch assembly release couplings by functioning as a guide.

It is contemplated that any modification discussed above in relation to the rolling launch assembly embodiment can be incorporated into this embodiment. Furthermore, a crank assembly can be substituted for the wheel as the force imparting member, i.e., although still capable of rolling, the wheel does not engage the first gear assembly. Thus, a crank coaxially mounted to a crankshaft and crankshaft gear is positioned to frictionally engage the annular member and cause rotation of the release coupling in a manner similar to that described above. It is also contemplated that the crank may be linked either directly or indirectly to the wheel, and when the crank is turned, the wheel is caused to turn and roll the launch assembly while simultaneously causing rotation of the release coupling.

In operation, clockwise rotation of the wheel 214 causes the disc 216 and first spur gear 220 to rotate counterclockwise, thus causing clockwise rotation and advancement of the second spur gear 222 along the arcuate slots 226 and 230 until it mates with the release coupling spur gear 234. Continued rotation of the wheel 214 causes counterclockwise rotation of the release coupling spur gear 234, release coupling shaft 238 and release coupling 236. When the release coupling of the figurine is releasably mated with the release coupling 236 of the rolling launch assembly, it will also rotate in the counterclockwise direction. If the release coupling spur gear 234 is caused to rotate counterclockwise at a rate much faster than the second spur gear 222, the second spur gear 222 of the first gear assembly travels along the arcuate slots 226 and 230 away from the release coupling spur gear 234 until it disengages and is no longer in external meshed contact with the release coupling spur gear 234. As is discussed below, disengagement is helpful with respect to operation and cooperation of the second gear assembly and the first gear assembly in utilizing the rolling launch assembly with flying override.

As was mentioned above, the rolling launch assembly with flying override has a second gear assembly capable of actuating the rotation imparting mechanism independently of the first gear assembly. Included therein is a reel 250 for receiving a pull string 252 which is wound thereabout for drawing against the force of a helical torsion spring. A reel spur gear 256 is coaxially mounted to the reel 250 such that the reel spur gear turns along with the reel 250. The reel spur gear 256, the reel 250 and the helical torsion spring 254 are slidably coaxially mounted over a support shaft 258 such that the shaft 258 is threaded through the reel spur gear 256, the reel 250, and the helical torsion spring 254. The support shaft 258 is stabilized and mounted to the top and bottom of the first and second gear assembly housing 232. Tension is maintained on the helical torsion spring 254 by an upper torsion spring lock 260 which secures one or more loops of wire from an upper portion of the helical torsion spring 254 to the assembly housing 232. One or more loops of wire from a lower portion of the helical torsion spring 254 are secured to the rim of the reel 250. Thus, one end of the pull string 252 is secured to the reel 250 and is windable thereabout, the helical torsion spring 254 being secured to the reel 250 for biasing the reel 250 against the force of pulling the pull string 252 and toward keeping the pull string 252 retracted and wound around the reel 250. As above, it should be understood that springs other than helical torsion springs may be used.

The reel spur gear 256 is oriented to be in external meshed contact with a slidable spur gear 262 such that rotation of the reel spur gear 256 imparts rotation to the slidable spur gear 262. The slidable spur gear 262 is mounted on a slidable spur gear shaft 264. One end of the slidable spur gear shaft 264 is slidably retained in an arcuate third slot 266 of the spur gear support housing 228 (see dotted lines in FIGS. 17 and 18) and the other end of the slidable spur gear shaft 264 is slidably retained in an arcuate fourth slot 268 of the first a second gear assembly housing 232. As the reel spur gear 256 rotates, it frictionally advances the slidable spur gear 262 along arcuate slots 266 and 268 in the direction of rotation. Thus, counterclockwise rotation of the reel spur gear 256 (when viewed from the top) advances the slidable spur gear 262 into external meshed engagement with the release coupling spur gear 234.

In operation, the pull string 252 is pulled, thereby imparting counterclockwise rotation to the reel spur gear 256 and causing clockwise rotation of the slidable spur gear 262. Frictional engagement advances the slidable spur gear 262 along arcuate slots 266 and 268 until it mates with the release coupling spur gear 234. Continued counterclockwise rotation of the reel spur gear 256 causes counterclockwise rotation of the release coupling spur gear 234, release coupling shaft 238 and release coupling 236. When the release coupling of the figurine is releasably mated with the release coupling 236 of the rolling launch assembly with flying override 200, it will also rotate in the counterclockwise direction. When the release coupling spur gear 234 rotates in the counterclockwise direction and the reel spur gear 256 is not being rotated, the slidable spur gear 262 of the second gear assembly is frictionally engaged and travels along the arcuate slots 266 and 268 away from the release coupling spur gear 234 until it is no longer in external meshed contact with the release coupling spur gear 234.

In accordance with the present invention, it is seen that actuating the first gear assembly disengages the second gear assembly by rotating the release coupling spur gear 234 in a counterclockwise direction. Conversely, actuating the second gear assembly also disengages the first gear assembly by causing the release coupling spur gear 234 to rotate in a counterclockwise direction. In a preferred embodiment, the second gear assembly provides a mechanical advantage to the second force imparting member, thus providing more torque and faster rotation of the slidable spur gear 262 as compared to the second spur gear 224 of the first gear assembly. In this manner, the second gear assembly overrides and disengages the first gear assembly and provides sufficient rotational velocity to launch the figurine into the air. In a preferred embodiment, the ratio of the first gear assembly is designed and configured to provide a rotational velocity below that needed to launch the figurine into the air so that rolling the launch assembly housing with flying override provides a spinning, but not flying configuration to the figurine. The spinning configuration is thus overridden by actuating the second gear assembly.

In another embodiment of the present invention, a launch assembly incorporates a plurality of rotation imparting mechanisms that can be actuated independently of other rotation imparting mechanisms situated in the launch assembly. Alternatively, a rotation imparting mechanism incorporates a plurality of release couplings which are activated in tandem, i.e., in conjunction with other release couplings contained in the launch assembly. In this manner, release couplings may be situated or positioned at any number of locations in or on a launch assembly.

Independently actuated rotation imparting mechanisms each incorporate a dedicated force imparting member. Thus, actuation of one force imparting member actuates one rotation imparting mechanism and one release coupling. For example, a launch assembly containing three independently actuated rotation imparting mechanism has three respective force imparting members that are capable of launching three figurines into the air. Any number of rotation imparting mechanisms can be incorporated depending on the size of the launch assembly housing.

Tandemly actuated release couplings share a common rotation imparting mechanism. For example, in a first aspect, the rotation imparting mechanism includes a first gear which is rotated by a force imparting member. The first gear is positioned to be in external meshed contact with two parallel gears which are each linked, either directly or indirectly, to separate release couplings. Thus, upon actuation of the force imparting member, rotation of the first gear causes simultaneous rotation of each of the two gears in contact with the first gear thus causing rotation of the release couplings coaxially linked to their respective gears.

Alternatively, in a second aspect of tandemly actuated release couplings, a force imparting member actuates a first gear which is in external meshed contact with a parallel second gear that rotates upon rotation of the first gear. The second gear is coaxially linked to a release coupling which rotates along with the second gear. The second gear is in external meshed contact with a parallel third gear that rotates upon rotation of the second gear. The third gear is coaxially linked to a release coupling which rotates along with the third gear. Subsequent gears and attendant release couplings may optionally be incorporated in like manner. It is contemplated that combinations of the first aspect and second aspect can be incorporated to provide a plurality of release couplings that rotate simultaneously. Indeed, tandemly activated release couplings can be interspersed with independently actuated rotation imparting mechanisms within a single launch assembly housing.

The above disclosure and examples should not be considered as limitations of the various embodiments and iterations of a launchable figurine device according to the present invention. Modifications may be made by those with skill in the art to the embodiments and examples given above. For example, while humanoid figurines are generally shown, it should be understood that all manner of figurine shapes are contemplated including animal, reptile, space alien, imaginative weapon, flower and the like. Although figurines having two opposed wings are shown, any number of aerodynamically acceptable wings can be incorporated. It is also contemplated that the figurine can be solid, hollow or of honeycomb construction and the like. The launch assemblies may also be modified in many aspects. For example, in any of the examples and embodiments the force imparting member may be a hand crank, rack and pinion assembly or an electric motor. It is contemplated that the reel may be directly connected to the release coupling or three or more spur gears may be connected in series to impart rotation to the release coupling. Gears other than spur gears may also be incorporated. In connection with the rolling launch assembly with flying override, one with skill in the art can substitute any number of known clutch assemblies to override one gear assembly in favor of another. Consequently, it is clear that modifications may be made by those with skill in the art that are within the scope of the following claims.

What is claimed is:

1. A launchable figurine device comprising a figurine, and a rotation imparting mechanism, the figurine has a posterior and an anterior and includes a body stem having a longitudinal axis, a first wing pivotally attached in a first aperture in the body stem and having a range of motion about an axis approximately orthogonal to the body stem longitudinal axis, a second wing pivotally attached in a second aperture in the body stem and having a range of motion about an axis approximately orthogonal to the body stem longitudinal axis, arrestors associated with the apertures to limit wing movement and a release coupling at the bottom-most portion of the body stem, the ranges of motion of the wings are parallel and displaced from each other by that length defined between the apertures, the rotation imparting mechanism being mechanically coupled to the figurine release coupling, wherein upon actuation of the rotation imparting mechanism, the figurine is caused to rotate thus causing the first wing to move anteriorly along the range of motion to an outspread position by centrifugal force imparted by rotation of the figurine and the second wing to move posteriorly along the range of motion to an outspread position by centrifugal force imparted by rotation of the figurine, such that when sufficient rotational velocity is achieved, the wings creates lift sufficient to launch the figurine into the air.

2. A launchable figurine device according to claim 1 wherein the rotation imparting mechanism includes a spring-biased pull string.

3. A launchable figurine device according to claim 2 wherein the rotation imparting mechanism is manually operable and includes a reel and a torsion spring, the pull string having one end secured to the reel and being windable around the reel, the torsion spring connected to the reel for biasing the reel against a force of pulling the pull string and rewinding the pull string.

4. A launchable figurine device according to claim 3 wherein the rotation imparting mechanism includes a first gear coaxially mounted to the reel, a second gear parallel to and in external meshed contact with the first gear, the second gear coaxially mounted to the release coupling of the rotation imparting mechanism, such that upon pulling the pull string, the reel and the first gear rotate which causes the second gear and release coupling of the rotation imparting mechanism to rotate.

5. A launchable figurine device according to claim 1 wherein the range of motion of the wings does not exceed about 100 degrees in relation to the body stem.

6. A launchable figurine device according to claim 1 comprising a self-standing housing containing the rotation imparting mechanism.

7. A launchable figurine device according to claim 1 wherein the rotation imparting mechanism includes a release coupling configured to releasable mate with the figurine release coupling.

8. A launchable figurine device according to claim 7 wherein the figurine release coupling and the release coupling of the rotation imparting mechanism combine and cooperate to form a spiral jaw clutch.

9. A launchable figurine device according to claim 7 wherein the figurine release coupling and the release coupling of the rotation imparting mechanism combine and cooperate to form a saw-tooth clutch.

10. A launchable figurine device according to claim 1 wherein the first and second wings are at least partially made of a soft polymeric material.

11. A launchable figurine device according to claim 10 wherein the polymeric material is in the form of a jackets which are secured to the wings.

12. A launchable figurine device according to claim 1 wherein two wings are pivotally attached opposingly on the figurine.

13. A launchable figurine device according to claim 1 wherein the figurine is in the shape of a humanoid doll having shoulders.

14. A launchable figurine device according to claim 13 wherein the two wings are pivotally attached at the shoulders of the humanoid doll.

15. A launchable figurine device comprising a figurine and a rotation imparting mechanism, the figurine including at least one wing and a release coupling, the rotation imparting mechanism being mechanically coupled to the figurine release coupling, wherein the rotation imparting mechanism includes a first gear assembly and a second gear assembly which operate independently of each other to cause rotation of the figurine, the first gear assembly actuated by a first force imparting member, the second gear assembly actuated by a second force imparting member, such that upon actuation of the rotation imparting mechanism by either of the first and second force imparting members, the figurine is caused to rotate and when sufficient rotational velocity is achieved, the wing creates lift sufficient to launch the figurine into the air.

16. A launchable figurine device according to claim 15 further comprising an override mechanism for allowing the second gear assembly to override and disengage the first gear assembly.

17. A launchable figurine device according to claim 15 wherein the first force imparting member is a wheel capable of rotating when rolled across a suitable surface, the wheel being linked to the release coupling of the rotation imparting mechanism such that rotation of the wheel causes rotation of the release coupling of the rotation imparting mechanism.

18. A launchable figurine device according to claim 17 wherein the wheel is indirectly linked to the release coupling of the rotation imparting mechanism.

19. A launchable figurine device according to claim 18 wherein the wheel engages a first gear which is oriented in external meshed contact with a second gear, the second gear slidably mounted such that upon rotation of the first gear, the second gear slides in the direction of rotation of the first gear until it engages with a third gear, the third gear coaxially linked with the release coupling of the rotation imparting mechanism, such that upon rotation of the wheel, the first gear is caused to rotate which causes the second gear to engage with and cause rotation of the third gear thus causing rotation of the release coupling of the rotation imparting mechanism.

20. A launchable figurine device according to claim 19 wherein the wheel is in substantially perpendicular contact with a rotatable annular member which is coaxially linked to the first gear such that upon rotation of the wheel, the annular member rotates and transmits rotation to the first gear.

21. A launchable figurine device according to claim 15 wherein the second force imparting member is a pull string, the second gear assembly including a reel and a torsion spring, the pull string having one end secured to the reel and being windable around the wheel, the torsion spring connected to the reel for biasing the reel against the force of pulling the pull string and retracting the pull string.

22. A launchable figurine device according to claim 21 wherein the second gear assembly includes a first gear coaxially mounted to the reel, a second gear parallel to and in external meshed contact with the first gear, the second gear slidably mounted such that upon rotation of the first gear, the second gear slides in the direction of rotation until it meshes with and engages a third gear, the third gear coaxially linked to the release coupling of the rotation imparting mechanism, such that upon pulling the pull string, the first gear causes the second gear to rotate and slide in the direction of the third gear until it engages with the third gear thus causing rotation of the release coupling of the rotation imparting member.

23. A launchable figurine device comprising a figurine and a rotation imparting mechanism, the figurine having an upper portion and a lower portion, the upper portion having at least one wing attached thereto, the lower portion having a release coupling mounted thereon, the rotation imparting mechanism having a release coupling configured to releaseably mate with the release coupling of the figurine, wherein the rotation imparting mechanism includes a first gear assembly and a second gear assembly which operate independently of each other to cause rotation of the figurine, the first gear assembly actuated by a first force imparting member, the second gear assembly actuated by a second force imparting member, such that when the figurine and the rotation imparting mechanism are releasably mated and upon actuation of the rotation imparting mechanism by either of the first and second force imparting members the figurine is caused to rotate and when sufficient rotational velocity is achieved, the wing creates lift sufficient to launch the figurine into the air.

24. A launchable figurine device comprising a figurine and a rotation imparting mechanism including a force imparting member, the figurine including an upper portion and a lower portion, the upper portion including at least one wing attached thereto, the lower portion having a release coupling mounted thereon, the rotation imparting mechanism including a release coupling configured to releaseably mate with the release coupling of the figurine to indirectly couple the force imparting member to the figurine, wherein the rotation imparting mechanism includes a first gear assembly and a second gear assembly which operate independently of each other to cause rotation of the figurine, the first gear assembly actuated by a first force imparting member, the second gear assembly actuated by a second fierce imparting member, such that upon actuation of the rotation imparting mechanism through either of the force imparting members, the figurine is caused to rotate and when sufficient rotational velocity is achieved, the wing creates lift sufficient to launch the figurine into the air.

25. A launchable figurine device comprising a figurine and a free-standing launch assembly, the figurine including at least one wing and a release coupling, the launch assembly including a housing containing a rotation imparting mechanism mechanically coupled to the figurine release coupling, wherein the rotation imparting mechanism includes a first gear assembly and a second gear assembly which operate independently of each other to cause rotation of the figurine, the first gear assembly actuated by a first force imparting member, the second gear assembly actuated by a second force imparting member, such that upon actuation of the rotation imparting mechanism by either of the first and second force imparting members, the figurine is caused to rotate and when sufficient rotational velocity is achieved, the wing creates lift sufficient to launch the figurine into the air.

26. A launchable figurine device comprising a figurine and a rotation imparting mechanism, the figurine including at least one wing and a release coupling, the rotation imparting mechanism having a release coupling configured to releaseably mate with the release coupling of the figurine, wherein the rotation imparting member includes a first gear assembly and a second gear assembly which operate independently of each other to cause rotation of the figurine, the first gear assembly actuated by a first force imparting member, the second gear assembly actuated by a second force imparting member, such that when the figurine and the rotation imparting mechanism are releasably mated and upon actuation of the rotation imparting mechanism by either of the first and second force imparting members, the figurine is caused to rotate and when sufficient rotational velocity is achieved, the wing creates lift sufficient to launch the figurine into the air.

27. A launchable figurine device comprising a figurine and a rotation imparting mechanism, the figurine having an upper portion and a lower portion, the upper portion having at least one wing attached thereto, the lower portion having a release coupling mounted thereon, the rotation imparting mechanism being mechanically coupled to the release coupling of the figurine, wherein the rotation imparting mechanism includes a first gear assembly and a second gear assembly which operate independently of each other to cause rotation of the figurine, the first gear assembly actuated by a first force imparting member, the second gear assembly actuated by a second force imparting member, such that actuation of the rotation imparting mechanism by either of the first and second force imparting members, provides torque to the release coupling of the figurine causing the figurine to rotate and when sufficient rotational velocity is achieved, the at least one wing creates lift sufficient to launch the figurine into the air.

28. A launchable figurine device comprising a figurine and a rotation imparting mechanism having a force imparting member, the figurine having an upper portion and a lower portion, the upper portion having at least one wing attached thereto, the lower portion having a release coupling mounted thereon, the rotation imparting mechanism being mechanically coupled to the release coupling of the figurine to indirectly couple the force imparting member to the figurine, wherein the rotation imparting mechanism includes a first gear assembly and a second gear assembly which operate independently of each other to cause rotation of the figurine, the first gear assembly actuated by a first force imparting member, the second gear assembly actuated by a second force imparting member, such that actuation of the rotation imparting mechanism through either of the force imparting members provides torque to the release coupling of the figurine causing the figurine to rotate and when sufficient rotational velocity is achieved, the wing creams lift sufficient to launch the figurine into the air.

* * * * *